United States Patent [19]

Dinkelmann

[11] Patent Number: 4,947,509

[45] Date of Patent: Aug. 14, 1990

[54] SUCTION DISTRIBUTION APPARATUS FOR A SPINNING MACHINE

[75] Inventor: Friedrich Dinkelmann, Rechberghausen, Fed. Rep. of Germany

[73] Assignee: Zinser Textilmashinen GmbH, Fed. Rep. of Germany

[21] Appl. No.: 320,321

[22] Filed: Mar. 7, 1989

[30] Foreign Application Priority Data

Mar. 29, 1988 [DE] Fed. Rep. of Germany ..... 3810588

[51] Int. Cl.[5] ..... A47L 5/38

[52] U.S. Cl. ..... 15/301; 15/314; 57/304

[58] Field of Search ..... 15/300 R, 301, 314; 57/301, 304

[56] References Cited

U.S. PATENT DOCUMENTS

| | | | |
|---|---|---|---|
| 1,048,477 | 12/1912 | Allington | 15/301 X |
| 2,140,420 | 12/1938 | Eaddy | 15/301 X |
| 2,431,726 | 12/1947 | Bechtler | 57/304 |
| 3,926,665 | 12/1975 | Harrap et al. | 57/301 X |
| 3,986,328 | 10/1976 | Harrap | 57/304 X |
| 4,773,208 | 9/1988 | Wolf | 57/304 X |

FOREIGN PATENT DOCUMENTS

| | | |
|---|---|---|
| 1748530 | 7/1957 | Fed. Rep. of Germany . |
| 1163711 | 2/1964 | Fed. Rep. of Germany . |
| 2643902 | 3/1977 | Fed. Rep. of Germany . |
| 1198101 | 12/1959 | France . |

*Primary Examiner*—Chris K. Moore

*Attorney, Agent, or Firm*—Shefte, Pinckney & Sawyer

[57] ABSTRACT

A suction device for communicating the suction nozzles of a plurality of spinning positions of a spinning machine with suction producing apparatus includes a plurality of intermediate conduits each communicating a respective discrete group of the suction nozzles with the suction producing apparatus.

7 Claims, 2 Drawing Sheets

SUCTION DISTRIBUTION APPARATUS FOR A SPINNING MACHINE

BACKGROUND OF THE INVENTION

The present invention relates to a suction distribution apparatus for a spinning machine having a plurality of spinning positions located on one or both sides of the machine, each of which includes a suction nozzle connected to a common suction apparatus.

In a typical spinning machine, each of the spinning positions is provided with a drafting system and a suction nozzle located in the area of the exit rollers thereof. These suction nozzles trap the roving material which continues to run following a yarn break and otherwise perform a cleaning function during normal operation. In the case of an extremely long spinning machine, such as, for example, a ring spinning machine having 500 spinning positions and 500 corresponding suction nozzles on each side of the machine, the challenge of designing a common suction arrangement which provides sufficient suction at all the suction nozzles is formidable.

In European Patent No. B-0070 377, an arrangement is disclosed for regulating the individual suction operations to a uniform level and includes an additional conduit disposed parallel to a suction conduit, which suction conduit is communicated with a plurality of suction nozzles. The additional conduit and the suction conduit are connected to the same suction apparatus and the additional conduit is communicated with the suction conduit via several cross conduits. However, in this device, the air currents are difficult to control, thereby creating the risk that one or several positions receive little or no air flow, in which event fibers deposited there could lead to clogging.

SUMMARY OF THE INVENTION

It is accordingly an object of the present invention to provide a suction control arrangement which assures uniform flow conditions at the suction nozzles and which minimizes the risk of zones with reduced flow speed, even in the case of very long spinning machines.

According to one aspect of the present invention, the suction nozzles of several adjacent spinning positions are connected in groups to individual conduit sections, which individual conduit sections are connected directly to the suction apparatus.

In this design the conduit sections are limited to lengths and to corresponding numbers of suction nozzles which still assure that essentially uniform or at least sufficient air flows are present at the individual suction nozzles. It is possible thereby to determine suitable divisions of conduit length and/or suitable conduit cross section experimentally.

A further aspect of the invention provides that the conduit sections are connected to the suction apparatus in such a manner that at least approximately the same vacuum is present at an interface end of each conduit section.

A further aspect of the invention provides that the conduit sections exhibit the same lengths, same cross sections and the same number of suction nozzles. It is possible with these measures to create a design with a preciseness sufficient in practice to achieve sufficiently uniform flow distributions without having to make complicated calculations and/or tests.

DETAILED DESCRIPTION OF THE PREFERRED EMBODIMENTS

Figure 1:
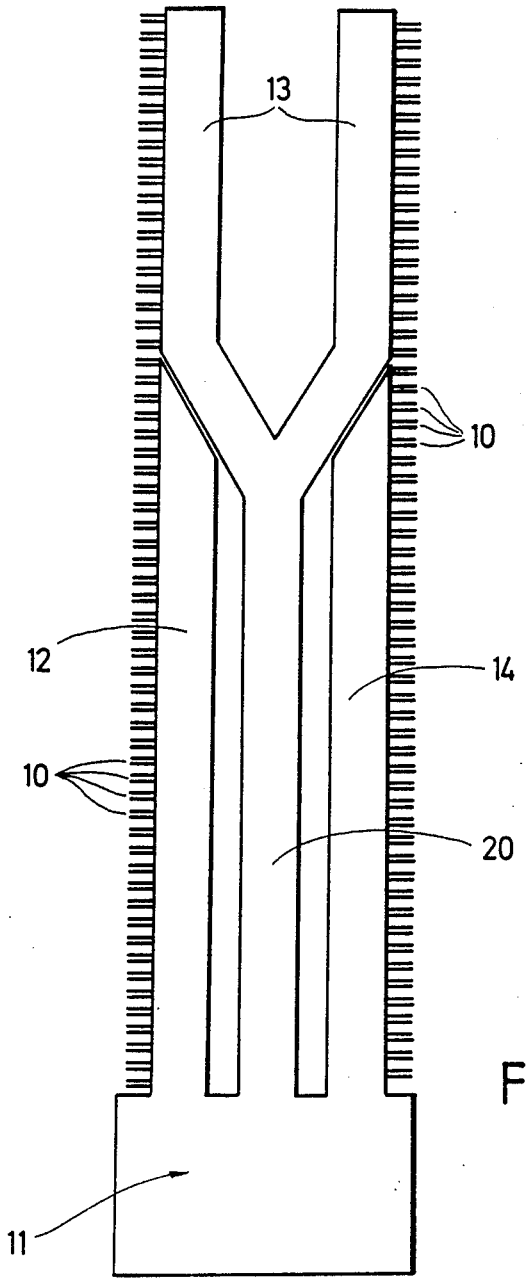
FIG. 1 is a schematic top plan view of one preferred embodiment of the suction apparatus of the present invention, incorporated in a ring spinning machine.

In FIG. 1, one preferred embodiment of the suction distribution apparatus of the present invention is illustrated. A suction apparatus of known construction, shown only representatively at 11, is disposed at one end of the drive frame of a textile machine such as, for example, a ring spinning machine having a plurality of spinning positions. The suction apparatus 11 includes a ventilator driven by an electric motor for creating a vacuum in a suction chamber of the suction apparatus 11. The suction chamber includes at least one filter element of known construction through which aspirated air is directed.

Each spinning position of the ring spinning machine is serviced by a separate drafting system and a suction nozzle representatively indicated at 10 is disposed in association with each drafting system. Each suction nozzle 10 performs a cleaning function during normal operation of its associated spinning position and, in the event of a yarn break at the spinning position, the suction action of suction nozzle 10 is applied to the roving material which may continue to travel from the drafting system following the yarn break.

According to the present invention, the suction nozzles 10 of several adjacent spinning positions are commonly communicated as a group with a respective intermediate conduit, such as a conduit section 12, 13 and 14. Specifically, the suction nozzles 10 on each side of the ring spinning machine most closely adjacent the suction apparatus 11 are communicated with a respective one of the conduit sections 12, 14 while the suction nozzles 10 at each side of the spinning machine most remote from the suction apparatus 11 are communicated with a respective one of the conduit sections 13. The conduit sections 12, 14 extend from the suction apparatus 11 along approximately two-thirds of the length of the machine, and, accordingly, approximately two-thirds of the suction nozzles 10 of each side of the machine are connected to them. The last one-third of the suction nozzles 10 of each machine side is connected to one of the conduit sections 13, which are connected via a common feed conduit 20 to the suction apparatus 11. The conduit sections 12, 14 and the conduit sections 13, via the common feed conduit 20, communicate directly with the suction chamber of the suction apparatus 11. The conduit sections 12, 13, 14, and the common feed conduit 20 have the same cross section. Moreover, the conduit sections 12, 14 are communicated with the same number of suction nozzles 10. On the other hand, each conduit section 13 individually communicates with only one-half the number of suction nozzles 10 as either one of the conduit sections 12, 14. Thus, the total number of suction nozzles 10 with which the conduit sections 13 collectively are communicated is the same as the number of suction nozzles 10 with which each of conduit sections 12, 14 alone is communicated. Thus, the same amounts of air are drawn via conduit sections 12, 13, 14 so that in essence the same flow conditions prevail.

The end portions of conduit sections 12, 13, 14 which are remote from the suction apparatus 11 are provided with openings (not shown) of a predetermined cross section which assure that a sufficient air flow is present even in the area of those suction nozzles 10 which are spaced furthest from the suction apparatus 11, whereby impurities and fibers drawn in by these remote suction nozzles can be removed in a reliable manner.

Figure 2:
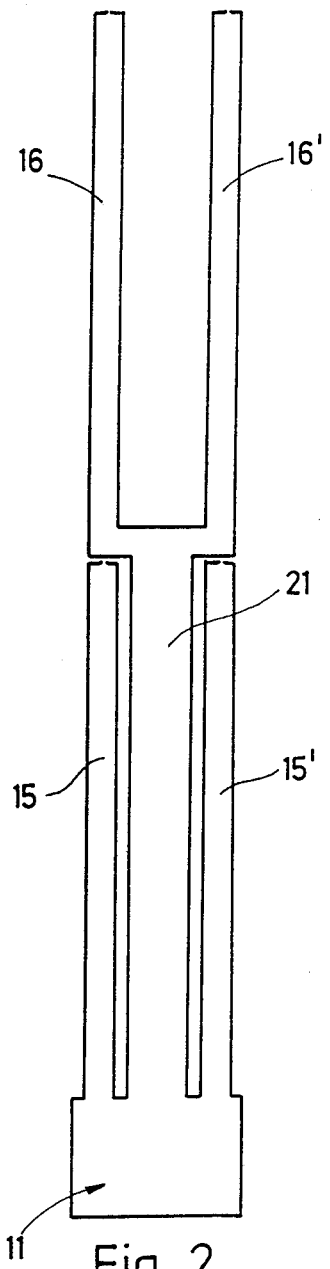
FIG. 2 is a schematic top plan view of another embodiment of the apparatus of the present invention.

In FIG. 2, another embodiment of the apparatus of the present invention is illustrated. Each side of the spinning machine is provided with a respective pair of conduit sections 15, 16 and 15', 16', with each of the individual conduit sections extending over approximately one half of the length of the machine and being communicated with approximately one half of the suction nozzles at one particular side of the machine. Specifically the two conduit sections 15, 15' respectively extending along the length of the machine adjacent to the suction device 11 and are connected directly to the suction chamber of the suction apparatus 11, while the conduit sections 16, 16' respectively extend along the length of the machine remote from the suction apparatus 11 and are connected via a common line 21 to the suction chamber of the suction apparatus 11. The conduit sections 15, 16 and 15', 16' have the same cross section and are communicated with the same number of section nozzles. The common line 21 is of a larger cross-section so that substantially the same vacuum is present at its interface with the conduits 16, 16' as is present at conduits 15, 15', thereby assuring that essentially uniform flow conditions prevail in conduits 15, 16 and 15', 16' and that essentially the same intake air flows occur at the individual suction nozzles.

Figure 3:
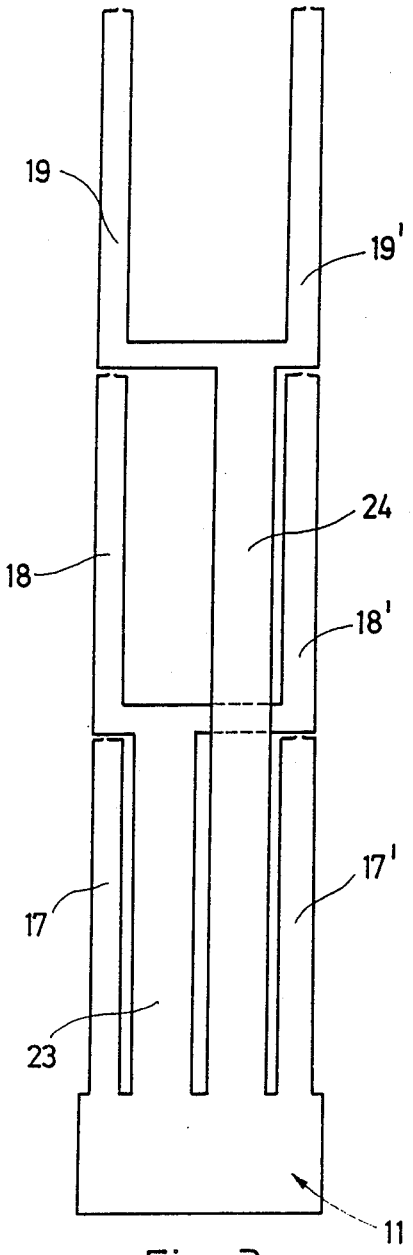
FIG. 3 is a schematic top plan view of a further embodiment of the apparatus of the present invention.

The embodiment of FIG. 3 illustrates another embodiment of the apparatus of the present invention and corresponds to the embodiment of FIG. 2 except that the number of conduit sections per machine side has been increased so that a more uniform distribution of air results within the conduit sections. One group of three conduit sections 17, 18, 19 or 17', 18', 19' is provided on each machine side and these conduit sections have the same cross sections, the same lengths and the same number of suction nozzles communicated therewith. These conduit sections are connected to the suction apparatus 11 in such a manner that at least approximately the same vacuum is present at each of their downstream openings. Specifically, the conduit sections 17, 17' extend along the length of the spinning machine most closely adjacent to the suction apparatus 11 and are connected directly to the suction chamber thereof, while the conduit sections 18, 18' and 19, 19' respectively extend along extents of the spinning machine more remote from the suction apparatus 11 and are each connected via respective common lines 23, 24 to the suction chamber of the suction apparatus 11. These common lines 23, 24 are preferably of enlarged cross-sections in relation to the conduits 17, 17', 18, 18', 19, 19' so that the vacuum prevailing in the suction chamber of the suction apparatus 11 is duplicated to the greatest extent possible at the downstream interfaces opening to each of conduit sections 18, 18', 19, 19'. This vacuum result can be approximately achieved by providing the common lines 23, 24 with a cross section approximately twice as large as the cross section of the respective conduit sections 18, 18' and 19, 19' connected therewith.

The present invention contemplates the possibility of further increasing the number of conduit sections per spinning machine, as necessary or desirable. It is likewise contemplated that the conduit sections may have different lengths and may be communicated with different numbers of suction nozzles. Further, if the differences in the suction flow conditions become too great, it could be advantageous to vary the cross sections of the differing conduit sections in relation to the number of suction nozzles serviced by the conduits to provide a suitable ratio of conduit sections with respect to the number of suction nozzles.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. In a spinning machine having a plurality of spinning positions arranged in a row extending longitudinally along one side of the spinning machine, each said spinning position having a suction nozzle thereat, and means for producing suction associated commonly with the suction nozzles, a suction distributing apparatus comprising means for interconnecting the suction nozzles and the suction producing means, said suction nozzles being interconnected to one another in a plurality of discrete groups each comprising plural adjacent suction nozzles, said interconnecting means including a plurality of intermediate conduits, each of said intermediate conduits communicating a respective discrete group of adjacent suction nozzles with the suction producing means.

2. In a spinning machine, a suction distributing apparatus according to claim 1 and characterized further in that said interconnecting means is arranged in communication with the suction production means for producing approximately the same vacuum conditions at an interface location with each of said conduits.

3. In a spinning machine, a suction distributing apparatus according to claim 1 and characterized further in that said conduits are approximately the same length, have approximately the same cross sections and are communicated with approximately the same number of the suction nozzles.

4. In a spinning machine, an apparatus according to claim 1 and characterized further in that said spinning positions are arranged at opposite sides of the spinning machine, a pair of said conduits being communicated respectively with suction nozzles at opposite sides of the spinning machine, said interconnecting means including a common feed conduit communicating the suction producing means with each of said pair of conduits.

5. In a spinning machine, an apparatus according to claim 4 and characterized further in that each of said pair of conduits has approximately the same length, approximately the same cross section and said common feed conduit has a cross section approximately equal to twice the cross section of one of said pair of conduits.

6. In a spinning machine, an apparatus according to claim 4 and characterized further by a pair of additional conduits, each of said additional conduits being communicated with another discrete group of the suction nozzles and being communicated directly with the suction producing means.

7. In a spinning machine having a plurality of spinning positions arranged at opposite sides of the spinning machine, at least some of which have a suction nozzle thereat, and means for producing suction associated commonly with the suction nozzles, a suction distributing apparatus comprising means for interconnecting the suction nozzles and the suction producing means, said interconnecting means including a plurality of intermediate conduits, each of said intermediate conduits being communicated with a respective discrete group of adjacent suction nozzles and with the suction producing means, a first pair of said conduits being communicated respectively with discrete groups of suction nozzles at opposite sides of the spinning machine, said interconnecting means including a common feed conduit communicating the suction producing means with each of said first pair of conduits, a second pair of said conduits being communicated respectively with other discrete groups of the suction nozzles and being communicated directly with the suction producing means, one of said first pair of conduits and one of said second pair of conduits being communicated with respective groups of suction nozzles on the same respective side of the spinning machine and the other of said first pair of conduits and the other of said second pair of conduits being communicated with respective groups of suction nozzles on the opposite side of the spinning machine, each of said second pair of conduits extending over approximately two-thirds of the length of the spinning machine, each of said first pair of conduits, said second pair of conduits and said common feed conduit having approximately the same cross section.

* * * * *